United States Patent [19]

Rado et al.

[11] Patent Number: 4,520,904

[45] Date of Patent: Jun. 4, 1985

[54] ELEVATOR LEVELING SIGNAL ERROR AND CORRECTION

[75] Inventors: David J. Rado, Granby; Steven D. Coste, Torrington, both of Conn.

[73] Assignee: Otis Elevator Company, Farmington, Conn.

[21] Appl. No.: 550,161

[22] Filed: Nov. 9, 1983

[51] Int. Cl.[3] ..... B66B 1/40

[52] U.S. Cl. ..... 187/29 R

[58] Field of Search ..... 187/29

[56] References Cited

U.S. PATENT DOCUMENTS

| | | | |
|---|---|---|---|
| 3,720,292 | 3/1973 | Magee | 187/29 |
| 3,749,203 | 7/1973 | Hoelscher | 187/29 |
| 3,815,711 | 6/1974 | Hoelscher | 187/29 |
| 4,114,731 | 9/1978 | Faup et al. | 187/29 |
| 4,256,203 | 3/1981 | Masel | 187/29 |
| 4,463,833 | 8/1984 | Ludwig et al. | 187/29 |

*Primary Examiner*—Bernard Roskoski
*Assistant Examiner*—W. E. Duncanson, Jr.
*Attorney, Agent, or Firm*—Robert E. Greenstien

[57] ABSTRACT

In an elevator that has a position indicator that indicates through separate indication signals if the car is above, at, or below floor level, the position indicator is checked prior to and during the approach to the floor for a stop, and if an incorrect indication is sensed, the error is stored. The stored error and the other indications are used during the approach to slow and stop the car and open the doors.

3 Claims, 5 Drawing Figures

ELEVATOR LEVELING SIGNAL ERROR AND CORRECTION

DESCRIPTION

1. Technical Field

This invention relates to stopping and leveling elevators.

2. Background Art

The conventional elevator has door-zone indicators (position sensors) that are a set distance from the floor and provide signals to indicate the car's position during its final approach to the floor. Usually three signals are produced as the car approaches that identify a narrow level range around the floor level and the level position, and, typically, their relative transition characteristics from ON to OFF and vice versa provide an accurate indication of the car position during its final approach and slowdown.

One or more of these signals may not change state correctly, and when this happens, conventional elevators dramatically alter elevator operation, sometimes treating a failure as an emergency situation that requires stopping the car or, at the very least, slowing running speed significantly. This is actually unnecessary.

DISCLOSURE OF INVENTION

It is clearly desirable not to dramatically alter elevator operation so significantly, and this is a principal object of the present invention.

According to the present invention, sensor or inductor signals are sensed well before the car approaches the floor, and if incorrect at that position, the correct signal is provided based upon the condition of the sensors as the car approaches the floor and enters the level zone. The system thus ostensibly ignores the difficulty, which allows the elevator car to at least come within the level zone and have the elevator doors open at a small distance about the floor, by computing what the correct signals should be. The effect of an inductor fault therefore does not cause a major change in system operation.

One aspect of the present invention is that the car can be stopped at a floor with other than a position sequenced approach, using the operating inductors. When a faulty indicator is determined, a special operating sequence is followed during each stop to generate the correct leveling signals notwithstanding.

A main feature of the present invention is that once a failure of the door-zone indicators is detected, it is permanently stored and the system automatically alters operation so that virtually normal operation can be achieved, eliminating the need to slow down the system or stop it entirely—as in conventional elevators.

BEST MODE FOR CARRYING OUT THE INVENTION

Figure 1:
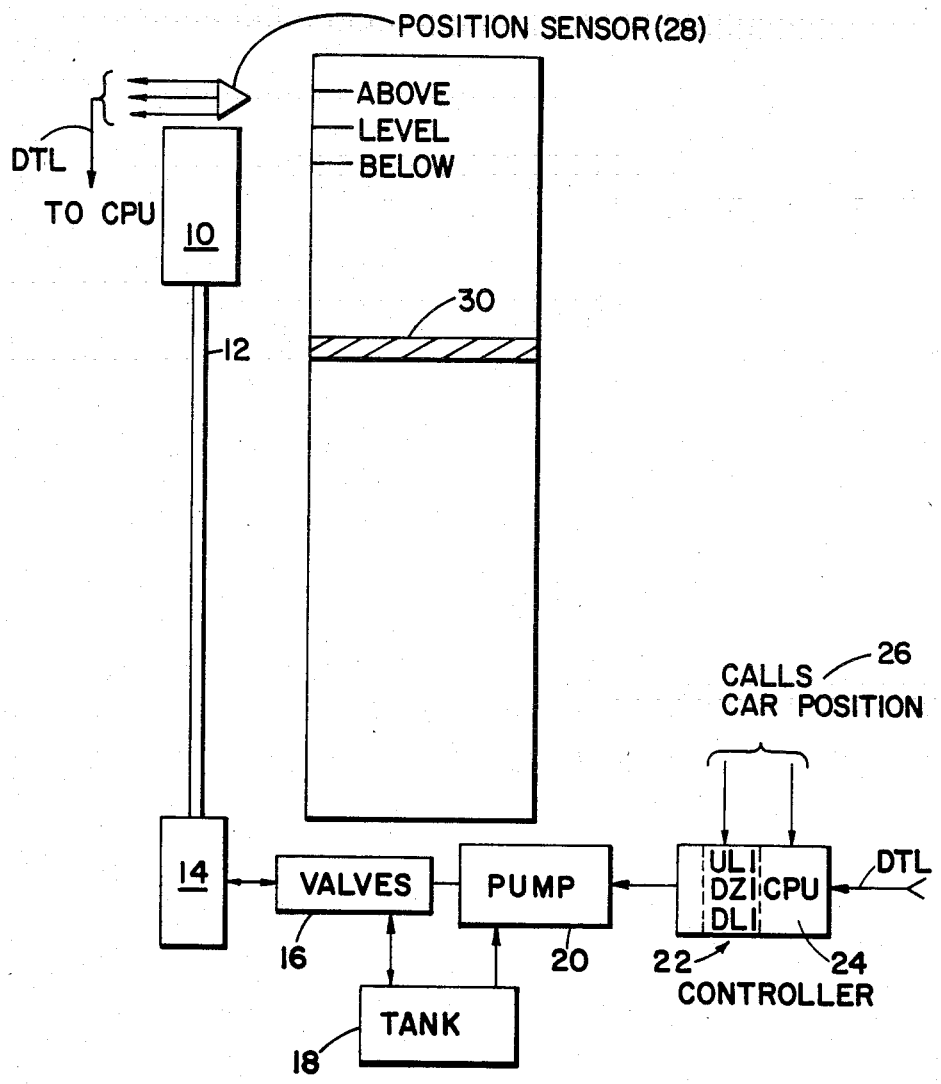
FIG. 1 is a simplified block diagram of a hydraulic elevator system that is computer-controlled and includes a position sensor which is utilized by the computer to generate ULI, DLI and DZ signals in controlling door motion and elevator stopping at each floor.

FIG. 1 is an extremely simplified view of a hydraulic elevator system. In this view, there is an elevator car 10 which is attached to a piston 12 which extends from a cylinder 14 into which fluid is pumped by means of valves 16 to and from a tank 18 in response to the operation of a pump 20. This pump is controlled by a controller 22 which includes a computer (CPU) 24, which, among other things, receives car calls and car position signals 26 and over a line DTL position signals from a position sensor 28 that senses the location of the car with respect to a landing 30. Those positions are above floor level, below the floor, and level. The CPU uses the position signals to provide three signals which, for present purposes are identified as follows, using "convention" language: an up level inductor (ULI) signal, which indicates that the car is a certain distance (e.g., 9 inches) below the floor; a down-level inductor (DLI) signal which indicates that the car is about the same distance above the floor level; and a door-zone inductor (DZI) signal which indicates that the car is roughly level with the floor. The position signals from the position sensor are discrete ON or OFF signals; their state and transition characteristics as the car approaches reflecting car position and location around the level zone (about 9 inches on either side of the floor). It is important to understand that in the system shown in FIG. 1 the ULI, DZI, and DLI signals are generated by the CPU in response to the *output* from the position sensor, and not the other systems, by the position sensor. Thus, if there is an error in the position sensor, there is an error in the overall control of the system in older systems, but, as mentioned earlier, it is the principal purpose of the present invention to determine if there are any such errors and then provide the proper ULI, DZI and DLI signals so the car can stop near the floor level and the doors can open. As will be demonstrated in the following description, the invention thereby achieves ostensibly a normal elevator operation, despite the failure of one position sensor, e.g., it is still ON or OFF.

Though not critical to an understanding of the present invention, it is certainly worth noting that as the car approaches the floor in the typical elevator system, the doors begin to open at some point before it reaches the floor level, and that operation is usually initiated on the receipt of one or more of the ULI, DZI and DLI signals. Similarly, the car is allowed to decelerate or begin a final approach to the floor from these signals. According to the invention, a system looks at the ULI, DZI and DLI signals that are generated from the position sensor by the CPU as the car approaches a floor and determines if they are correct and if not, stores the error and makes a signal correction. By storing the error the correction may be made at each stop, which means the elevator continues to be operative for carrying passengers.

The processing carried out by the CPU for this purpose occurs at an extremely high rate as the car approaches. Thus, the ULI, DZI, and DLI signals may be appropriately corrected and augmented during the approach to achieve near normal elevator operation.

Figure 2:
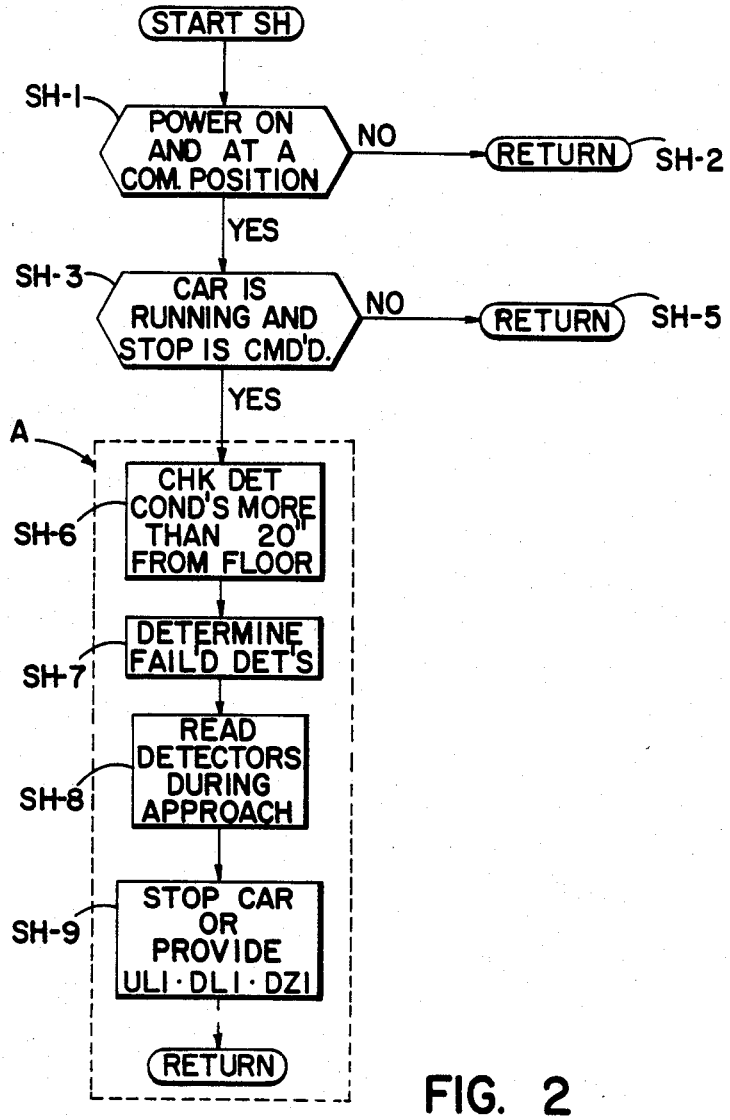
FIG. 2 is a block diagram showing a sequence of operations for generating those signals in accordance with the present invention.

The augmenting process by which the proper ULI, DZI and DLI signals are generated is accomplished by the CPU. An explanation of that operation begins with FIG. 2, which shows a flow chart of the overall sequences carried out by the CPU in a "self-health" (SH) routine.

When the car is running between the floor, a first test, at SH-1, is made to determine whether the power is on and the car is at a committable position; that is, is it between floors and will it stop at the next floor either going up or going down? If not, the sequence is ended and a return, at SH-2, is made to the main program. If the answer is affirmative, however, a second test, at SH-3, is made as to whether the car is running and a stop is commanded. If the answer is affirmative, a special sequence or subroutine sequence A is initiated, which checks the status of the detectors in preparation for augmenting the ULI, DZI and DLI signals. If the answer to test SH-3 is in the negative, however, that is, the car is not running and a stop is not commanded at the next floor, a return is made at SH-5 to the main program.

In sequence A the first step, at SH-6, is to check the detector conditions when the car reaches the deceleration zone, e.g., 20 inches from the floor. Then a check is made to determine whether there are any failed detectors; this is step SH-7. If there are failed detectors in the next step, SH-8, the detectors are corrected for during the final approach to the floor, that is, when it is approximately 3 inches (in the level zone) from the floor and preparing to slow down and begin opening the door(s). In the next step, at SH-9, the car is immediately stopped if there is a certain type of detector failure (e.g., the DZI is low when it should be high) and if there is a certain type of fault detected (a special subroutine), then the fault is augmented to allow the car to relevel at the floor, or, alternatively, the proper ULI, DZI or DLI signals are generated.

Figure 3:
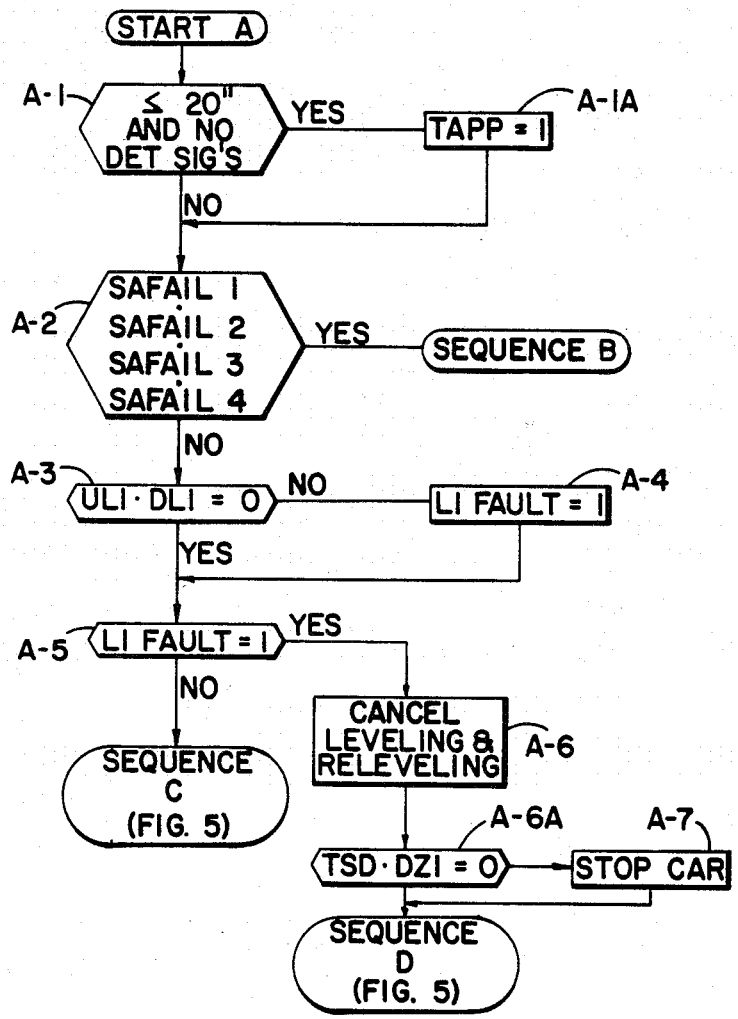
FIG. 3 is a flow chart and shows in detail subroutines in the flow chart in FIG. 2.

FIG. 3 shows the subroutine, sequence A, which mainly determines if there are faults in the generation of the ULI or DLI signals. At the first step A-1 in this sequence a test is made when the car is less than 20 inches from the floor to determine if at the same time there are no detector output signals. If the answer is yes, a flag is set (TAPP), ATA-1A mainly indicating that a "terminal approach" has correctly begun. In the next step, at A-2, a test is made to determine if there are any earlier safety failures, hereafter referred to as "SAFAIL". If the answer to test A-2 is negative, then a test at A-3 is made to determine at this position (which is less than 20 inches from the floor approach) if either the ULI or DLI signal is zero. At this point it should be zero, since typically the car will be outside the position at which either signal will be generated. But if the answer is no to test A-3, that is, either one of the ULI or DLI signals which is being produced by the CPU is high, then there is a landing inductor fault and the flag LIFAULT is set to one at A-4. In the next step, A-5, if the landing inductor fault is equal to one, then all normal cancelling and leveling routines in the system are ignored, and a test is made at A-6 to see if the car is at a terminal slow-down distance and if the door-zone indicator is correctly still zero. At this time, the car should be at a terminal slowdown distance, but the door-zone indicator should be zero; if it is not, there is a fault in the door-zone indicator and the car is brought to an immediate stop at A-7. Then sequence D is entered (see FIG. 5). If, however, the LIFAULT is not one, then sequence C (see FIG. 5) is entered. At that point the car is continuing to move, of course, whereas at the previous point, at step A-7, the car has been stopped at some distance from the floor. Through sequence D the proper signals will be generated to allow the car doors to open and the car to level reasonably correctly.

Figure 4:
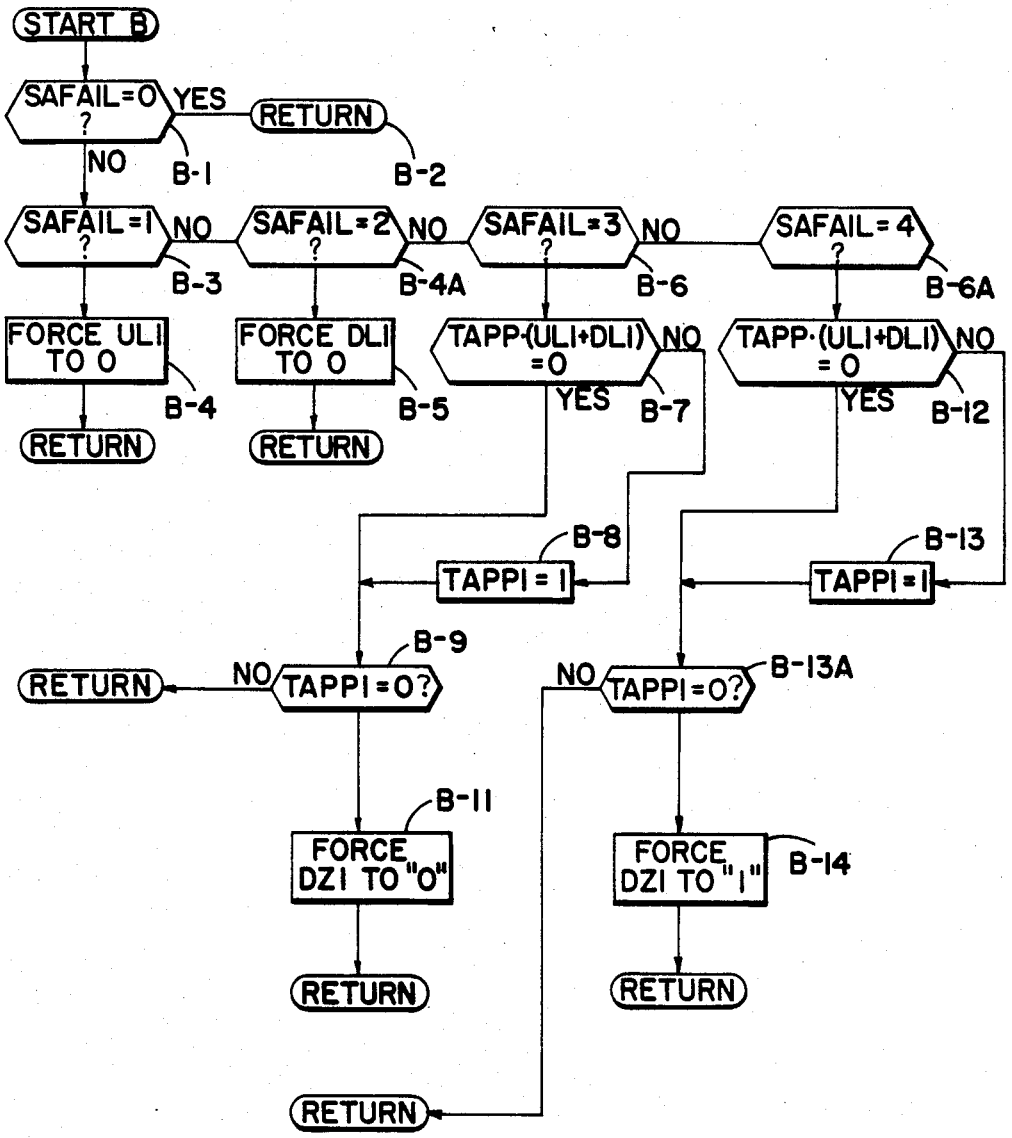
FIG. 4 is a flow chart and shows subroutines in the flow chart in FIG. 2.

FIG. 4 shows the subroutine characterizing sequence B, which is accessed on a negative answer to the SAFAIL test A-2, in FIG. 3. In the first step marking this sequence an initialization step, so to speak, is made at B-1 to determine if SAFAIL is zero. If it is, there are no faults and a return is made to the main program at B-2. If the answer is in the negative, the second test B-3 determines if there is a previously stored SAFAIL equal to one. (The generation of the SAFAIL 1, 2, 3 and 4 flags will be explained in the following, as provided in sequence D.) If SAFAIL equals one, then the ULI has been found locked in a high status, which is incorrect; it then is forced to zero at B-4. If SAFAIL is not one, the next test B-4A determines if SAFAIL is equal to two, and if it is, the DLI signal is high and thus at step B-5 the DLI is forced to zero. If SAFAIL is not equal to two, the next test, at B-6, determines if it is equal to three. If it is, then a test, B-7, is made to determine if a terminal approach has begun and either the ULI or DLI is high. Assuming a terminal approach has begun, either the ULI or DLI should be high, and thus if the test is negative, this has not happened, in which case a TAPP1 flag is set to one at B-8. If it is positive or affirmative, then the next test, at B-9, determines if TAPP1 is equal to zero. If it is not, a return is made to the program; ultimately, the SAFAIL equals three test will be run again and again and when the TAPP1 equals zero, the DZI signal is forced to zero at step B-11, it being incorrectly high or at one—as indicated by the SAFAIL=3 stored condition, which was derived from a test made under sequence D. What this particular sequence has done is to wait until the car is in the correct position to change the DZI signal from high to low. If, however the SAFAIL equal 3 test is negative, the next test ATB-6A, is to determine if it is equal to four, which as explained later is a flag indicating that the DZI signal is incorrectly at zero, that is, it is stuck—will not change from zero to one as the car approaches. In this routine again the test is made if a terminal approach has begun and either the ULI or a DLI signal is high, this time at B-12. If both conditions are not met, the answer is in the negative and the TAPP1 signal is set to one at B-13. In the next test ATB-13A, the question is asked if the TAPP1 is equal to zero. Once again, if the answer is in the negative, the procedure is again repeated until TAPP1 does equal zero, and then in the next step the DZI is forced from zero to one, at B-14. Observe, this operation has occurred very rapidly during the initial approach of the car to the floor, and some of the tests designed to continuously monitor the change in the ULI, DZI and DLI signals before and after a terminal approach has begun, in order to correctly augment those signals if there is a failure in one or more of them, either during the approach or based upon a test made during an earlier approach on another floor.

Figure 5:
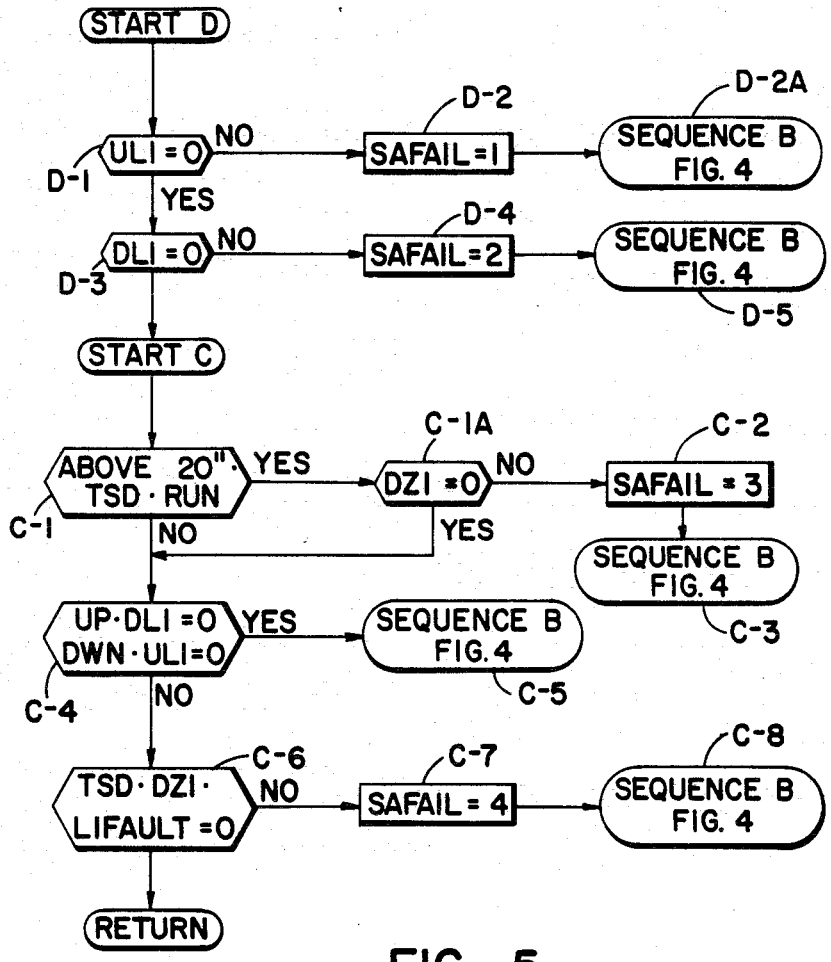
FIG. 5 is also a flow chart and shows subroutines for the sequence shown in FIG. 2.

FIG. 5 shows sequence D, and its explanation will help demonstrate how the SAFAIL flags that were utilized in the sequence D were determined. In sequence D, a first test, at D-1, is made to determine if the ULI is equal to zero. Under normal operations, when the car is outside the leveling zone, it should be equal to zero, and if it is not, the SAFAIL is set to one, ATD-2 then the sequence B is entered at D-2A. If ULI is operating correctly, is equal to zero, the next test at D-3 determines if the DLI is equal to zero, and normally it should be. But, if it is not, SAFAIL is set at two at D-4 and sequence B is then accessed at D-5. If DLI is equal to zero, then sequence C is accessed. It may also be accessed from sequence A (see FIG. 3). Sequence C begins at a point above 20 inches from the floor and, more precisely, with a test at C-1 to determine if at a position 20 inches from the floor, terminal slowdown has been requested but the car is running. If the answer is in the affirmative, the status of the DZI is tested ATC-1A. It should be equal to zero, but if it is not, the SAFAIL flag is set at 3, at C-2, and then sequence B is accessed at C-3. If the DZI is zero, a next test is made basically to determine if it is locked in the zero position. This requires testing the sequence of DLI, ULI and DZI signals as the car approaches the leveling zone. A first test is made at C-4 to determine if either one or two conditions is met: either the car is moving up and the DLI is equal to zero, or the car is moving down the ULI is equal to zero. If the answer is affirmative, then sequence B is selected ATC-5 (there rs no improper operation detected so far). When the car approaches the leveling zone, however, the previous test will yield a negative answer, and thus the next test C-6 is made to determine if a terminal slowdown has begun. The DZI signal should be high and the landing indicator fault is high at this time. If the answer is negative, then the DZI signal is latched low and SAFAIL is set at four, at C-7, indicating that condition. Then sequence B is accessed at C-8. But, if the answer is in the affirmative, then correct DZI operation has been detected and a return is made to the program.

The foregoing demonstrates that this system, through an iterative process during the approach to the floor and during leveling incorrect detector operation producing incorrect DZI, ULI or DLI signals are rapidly detected and forces these signals to their correct status very rapidly so the car can level near the floor and the doors can open reasonably normally despite the fault.

The foregoing description considers modifications, variations and alterations to the present invention and, in addition to those and without departing from the true scope and spirit of the invention, others will be obvious to one skilled in the art.

I claim:

1. An elevator comprising a car, a car propulsion system, a car motion control for controlling the propulsion sysem, and a position indicator for providing indications of car position when the car is above a floor, below the floor, and near floor level, characterized in that:

the motion control comprises processing means responsive to indications of car position for providing a first signal when the car is above the floor level at a certain first distance, a second signal when the car is at the floor level, and a third signal when the car is below the floor level by a certain preset distance, for providing a fourth signal that manifests that one of the indications is incorrect as the car approaches a floor and for providing one of those three signals in response to said fourth signal, means for storing the fourth signal and providing said one of the three signals at each successive floor stop, and means for slowing and stopping the car and opening the doors in response to the three signals.

2. An elevator according to claim 1, characterized in that the processing means comprises means for providing a fifth signal which indicates that one of the indications is incorrect as the car decelerates from either a preset distance above or below the floor, for providing, in response to said fifth signal a second one of the three signals that indicates the correct position of the car in response to the condition of the other indications at the time the fifth signal is provided, and for storing the fifth signal and providing that second one of the three signals each time the car approaches a floor for a stop at the floor.

3. An elevator according to claim 1, characterized in that the processing means comprises means for providing one of the three signals to stop the car after a predetermined time following generation of the fourth signal.

* * * * *

UNITED STATES PATENT AND TRADEMARK OFFICE

CERTIFICATE OF CORRECTION

PATENT NO. : 4,520,904

DATED : June 4, 1985

INVENTOR(S) : David J. Rado; Steven D. Coste

It is certified that error appears in the above-identified patent and that said Letters Patent is hereby corrected as shown below:

Column 4, line 39, "ATB-6A" should read --at B-6A--.

Column 4, line 48, "ATB-13A" should read --at B-13A--.

Column 4, line 67, "ATD-2" should read --at D-2--.

Column 5, line 12, "ATC-1A" should read --at C-1A--.

Column 5, line 22, "ATC-5 (there rs" should read --at C-5 (there is--.

Column 6, line 7, "sysem" should read --system--.

Signed and Sealed this

*Twenty-seventh* Day of *August 1985*

[SEAL]

*Attest:*

DONALD J. QUIGG

*Attesting Officer* *Acting Commissioner of Patents and Trademarks*